US005536063A

United States Patent [19]

Cable

[11] Patent Number: 5,536,063

[45] Date of Patent: Jul. 16, 1996

[54] COLLAPSIBLE RECREATIONAL CHAIR

[76] Inventor: C. Cecelia Cable, 3433 E. Shaw Butte Dr., Phoenix, Ariz. 85028-1334

[21] Appl. No.: 368,438

[22] Filed: Jan. 4, 1995

[51] Int. Cl.[6] ..... A47C 4/28

[52] U.S. Cl. ..... 297/16.2; 297/45; 297/440.16

[58] Field of Search ..... 297/45, 16.2, 59, 297/16.1, 440.16

[56] References Cited

U.S. PATENT DOCUMENTS

| | | | |
|---|---|---|---|
| Re. 31,760 | 12/1984 | Kassai | 297/45 X |
| 1,263,717 | 4/1918 | Stone | 297/45 |
| 1,381,136 | 6/1921 | Ribeiro | 297/16.2 X |
| 3,977,721 | 8/1976 | Peterson | 297/45 |
| 4,243,263 | 1/1981 | Thiboutot | 297/45 X |
| 4,245,849 | 1/1981 | Thiboutot | 297/16.2 X |
| 4,715,650 | 12/1987 | Berman et al. | 297/45 X |
| 4,801,176 | 1/1989 | Wolberg | 297/45 X |
| 4,890,882 | 1/1990 | Harrington . | |
| 5,058,950 | 10/1991 | Mann | 297/16.2 X |
| 5,069,503 | 12/1991 | Martinez . | |
| 5,244,250 | 9/1993 | Nordmeyer | 297/16.2 X |

FOREIGN PATENT DOCUMENTS

| | | | |
|---|---|---|---|
| 241062 | 7/1965 | Austria . | |
| 585711 | 12/1924 | France | 297/45 |
| 63123 | 4/1955 | France . | |
| 1202042 | 7/1959 | France | 248/188.8 |
| 2458248 | 2/1981 | France | 248/188.8 |
| 79735 | 6/1955 | Netherlands . | |
| 98121 | 2/1940 | Sweden . | |
| 816179 | 7/1959 | United Kingdom | 297/16.2 |
| 1417575 | 12/1975 | United Kingdom . | |
| 2026312 | 2/1980 | United Kingdom | 297/440.16 |

*Primary Examiner*—Peter M. Cuomo
*Assistant Examiner*—David E. Allred
*Attorney, Agent, or Firm*—Richard C. Litman

[57] ABSTRACT

A recreational chair may be assembled for a seated chair condition or disassembled or folded to a collapsed compact condition for easy handling and storage purposes. Rods form a square seat frame and are pivotably connected at their respective median points whereby the rod members may be folded in half for the compact storage condition. Each rod is bifurcated and the bifurcated parts constitute a snap-latch device whereby in a closed position, the device is locked for the seating condition and in an open position, the device is unlocked for the collapsible storage condition. Leg members and back frame members of the chair are constructed of hollow tubes which are made of a durable rigid lightweight material such as plastic, aluminum or steel. Supporting seat and back canvas swatches are mounted on their respective frames and each of the swatches may be compactly rolled for storage. The legs are adjustably mounted by virtue of their telescopic collapsible and spring-bias features which allows for various height settings of the chair and for collapsing for compact storage. The seat and back frames, the canvas swatches, and the legs in their respective collapsed conditions may be arranged in an elongated manner for storing in an elongated pouch made of plastic, leather or nylon.

10 Claims, 4 Drawing Sheets

COLLAPSIBLE RECREATIONAL CHAIR

BACKGROUND OF THE INVENTION

1. Field of the Invention

The present invention relates to a collapsible recreational chair which may be easily assembled for a seated chair position or may be readily disassembly or folded into a collapsed compact position for easy handling and storage purposes.

2. Description of the Prior Art

The prior art includes folding and collapsible chair structures of a number of different constructions and configurations. U.S. Pat. No. 4,890,882 to Harrington relates to a collapsible chair having arms and relatively short leg supports. U.S. Pat. No. 5,058,950 to Mann relates to a foldable chair including arms and a complex linkage systems interconnecting the legs. Generally, a collapsible/foldable chair in a recreational environment such as a beach, needs only seat and leg members, and arm members are not necessary. The addition of arm members merely adds to the complexity and weight of the collapsible/foldable chair.

A number of other inventions pertaining to collapsible/foldable chairs have been proposed by the prior art. Patents illustrating these types of inventions include: U.S. Pat. No. 5,069,503; U.S. Pat. No. 5,244,250; French Patent No. 63,123; and Netherlands Patent No. 79,735.

None of the above inventions and patents, taken either singly or in combination, is seen to describe the instant invention as claimed.

SUMMARY OF THE INVENTION

The present invention relates to a recreational chair which may be easily assembled for a seated chair condition or may be readily disassembly or folded to a collapsed compact condition for easy handling and storage purposes. Rods form a square seat frame and are pivotably connected at their respective median points whereby the rod members may be folded in half for the compact storage condition. Each rod is bifurcated and the bifurcated parts constitute a snap-latch device whereby in a closed position, the device is locked for the seating condition and in an open position, the device is unlocked for the collapsible storage condition. Leg members and back frame members of the chair are constructed of hollow tubes which are made of a durable rigid lightweight material such as plastic, aluminum or steel. Supporting seat and back canvas swatches are mounted on their respective frames and each of the swatches may be compactly rolled for storage. The legs are adjustably mounted by virtue of their telescopic collapsible and spring-bias features which allows for various height settings of the chair and for collapsing for compact storage. The seat and back frames, the canvas swatches, and the legs in their respective collapsed conditions may be arranged in an elongated manner for storing in an elongated pouch made of plastic, leather or nylon.

Accordingly, it is a principal object of the invention to provide a recreational chair which is rigid in its assembled seated chair position and which is collapsible into an elongated compact package for easy handling, shipping and storage purposes.

It is another object of the invention to provide a recreational chair which is relatively simple in design, of lightweight construction and which is designed to be conveniently carried by the user.

It is a further object of the invention to provide a recreational chair which has telescoping engaged, hollow legs which may be axially moved between extended and retracted positions for obtaining various height settings of the chair.

Still another object of the invention is to provide a recreational chair of the aforementioned collapsible character in combination with a pouch in which the collapsible chair may be placed therein in its compact package condition for easy transport or storage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
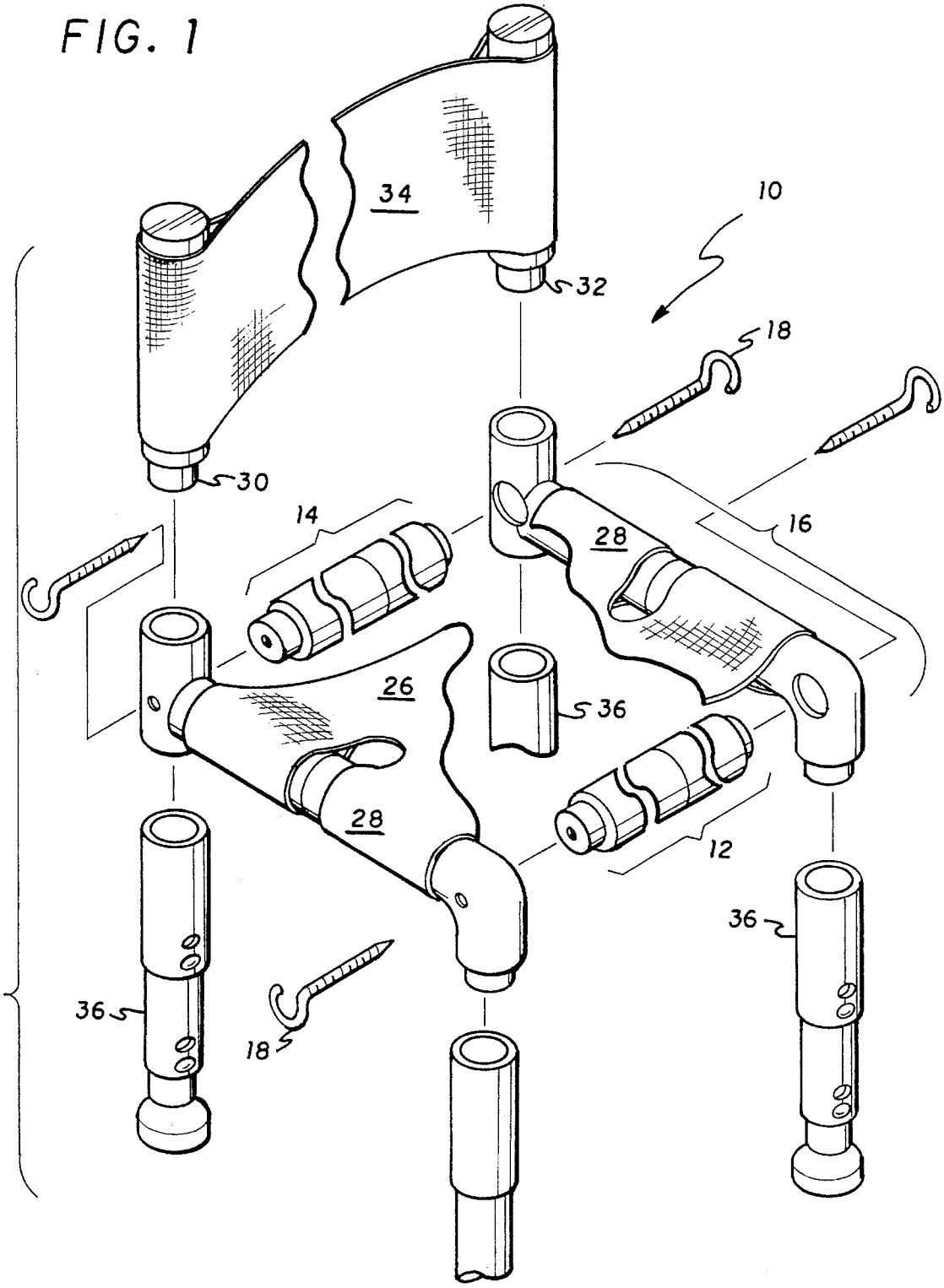
FIG. 1 is an exploded fragmentary perspective view of a recreational chair in accordance with the invention.

In FIG. 1, there is generally shown in an exploded fragmentary view of a recreational chair of the present invention which is adapted to be assembled for a seated chair position or to be disassembled or folded in its collapsed position for storage in an elongated-shaped pouch which is easily transportable. The chair has a square seat portion, a back portion and leg members, but no armrests. Generally, a collapsible/foldable chair in a recreational environment such as a beach, needs only seat, back and leg members, and arm members are not necessary. The seat frame is formed by flat rod-type members which are foldable. Hollow tubular members are used for two back frame members and four leg members. The leg members are adjustable as to height. The frame and leg members are shown in FIG. 1 as being made of a metal, such as aluminum or steel, but also could be made of a plastic material and the like. Suitable means are utilized to connect the frame, back and legs for their collapsible/foldable feature. Thin flexible fabric material for the seat support portion and the back support portion is shown as a rolled-type canvas material, but also could be other materials such as plastic, leather or nylon. The fabric material is removable from the chair construction and may be cleaned by washing and the like.

More specifically, in FIG. 1, there is shown a chair 10 which includes a seat portion having a horizontally-mounted substantially-square frame of front, rear, and side members 12. The respective ends of the frame members 12 are secured by rivet-type connectors 14 into sidewalls of top portions of leg members 16.

As illustrated in FIG. 1, each of the seat frame members 12 is bifurcated at its substantially median point for achieving a compact foldable condition. The two parts or sections of each of the seat frame members 12 are identified in FIG. 2 as first section 18 and second section 20. Broadly, the two sections 18, 20 constitute a snap-latch structural arrangement for hinging the sections either in a rigid horizontal position for the seating condition or folded in half for the storage condition. Each of the sections 18, 20 has an extending male-type nose portion 22 and an adjacent female-type U-shaped holder 24 at its inner end thereof whereby the nose portion of one section snaps into the U-shaped holder of the other section. Thus, the nose portion 22 operatively interacts with the U-shaped holder 24 during its closed condition for the seating condition. The snap-latch is open during the foldable storage condition. A rivet-type connector 26 is secured at a common point near the nose portions 22 of two interacting sections 18, 20 for providing a pivotably and hingedly connection between the two sections 22, 24. A hole is provided in the outer end of the sections 18, 20 for receiving the rivet-type member 14.

A flexible fabric patch or swatch 28 covers the square frame of the seat portion. Each of the side edges of the fabric patch 28 terminates in an elongated sleeve member 30. Thus, the sleeve members 30 are extended edge portions of the oppositely opposed side portions of the patch 28 are supported by the oppositely opposed side frame members 12. The patch 28 with its side sleeve members 30 is assembled by inserting or slidably fitting the sleeve members 30 in a single movement of the patch 28 to surround the outer surfaces of the side seat members 12 which movement is prior to the assembling of the front seat member 12 or the rear seat member 12 to the frame. Thus, the fabric patch 28 is securely anchored by its sleeve members 30 onto the side frame members 12 and constitutes a rigid and sturdy seat supporting area for the chair 10.

The chair 10 includes a back support portion having an upstanding frame which is formed of a first and second rear back member 32. A flexible fabric patch or swatch 34 covers the formed frame for the back portion. The pair of sleeve members of the patch 34 is inserted or slidably fitted from the top of the chair 10 to surround back members 32 in a similar manner to the slidable fitting of the seat patch 28 onto the side seat members 12. Thus, the fabric patch 34 is securely anchored by its set of sleeve members onto the back frame members 32 and constitutes a rigid and sturdy back supporting area for the chair 10.

Figure 3:
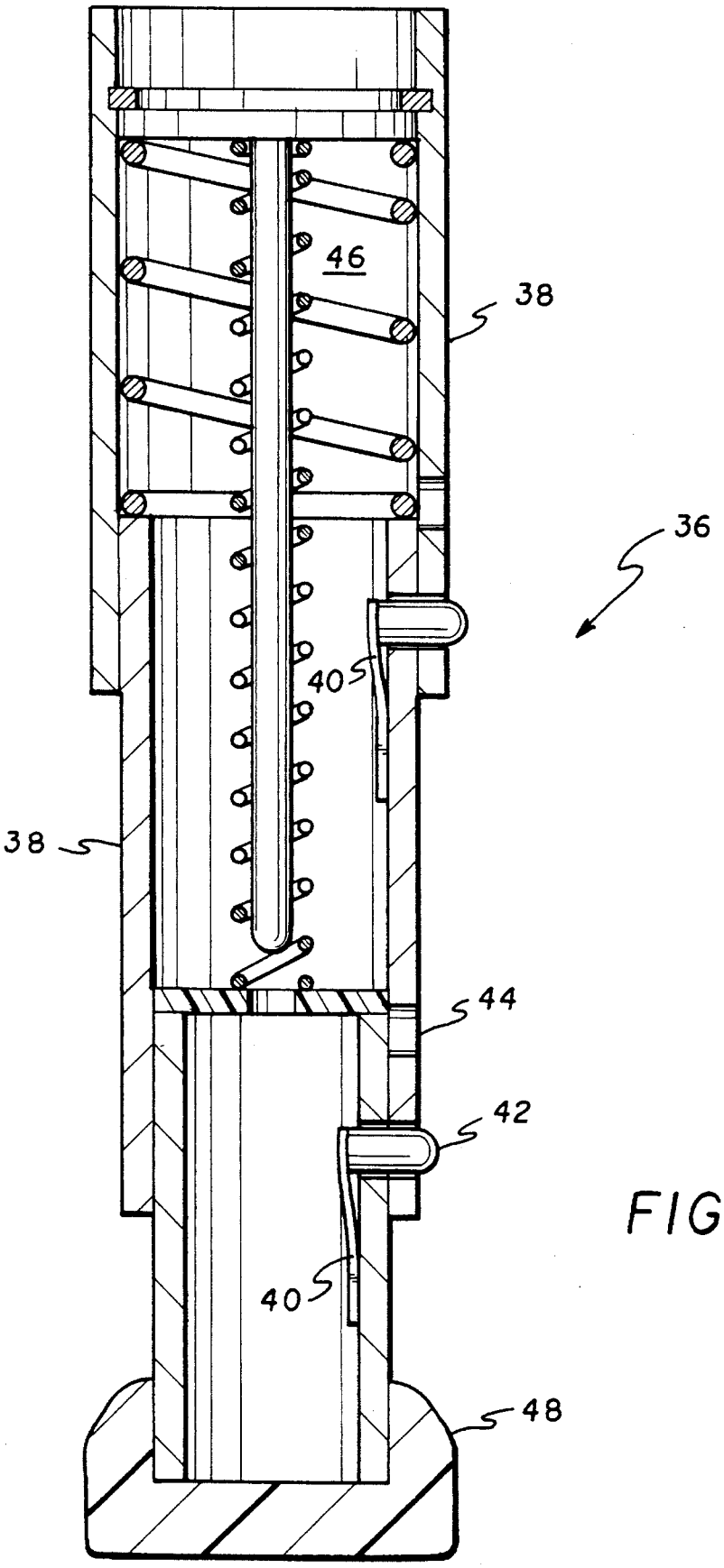
FIG. 3 is an exploded view of an adjustably-mounted telescopic leg member with its non-skid foot.

The chair 10 includes four substantially identical leg members 16. As an example of the leg construction for chair 10, there is shown in FIG. 3, the adjustable mounting feature for one of the leg members 16. Each of the legs 16 is formed of a series of conventional telescopic-type hollow tubular segments 36 connected in end-to-end relation for an axial, telescoping movement between mutually extended and retracted positions for the leg members 16. The height of the leg member 16 is determined by the actuation of a conventional arm 38-detent 40 structural unit associated with an opening 42 in the wall of the segment 36. There are a series of openings 42 located at spaced positions on the segment wall whereby the height of the leg member 16 is adjusted to different levels. As seen in FIG. 3 there are illustrated two arm-detent units operatively associated with the walls of the respective segments 36 to secure the respective segments whereby a range of heights is obtained. Each of the arms 38 is welded or the like to the wall of the segment 36. Each of the arms 38 has the spring-biased detent 40 attached to the top portion of the arm 38. Thus, the detent 40 has the spring-operated arm 38 for positioning and holding the detent 40 in relation to the arm 38 so that the unit can be released by a force applied to the detent 40. The detent 40 is operatively positioned to snap in place in a selected opening. The leg member 16 is fixed in a secured position by the actuation of a conventional-type spring-pressed mechanism 44 which is mounted within the tubular leg member 16 as shown in FIG. 3. By the actuation of the mechanism 44, a desired position within the range determined by the positioning of the respective detents 40 in the openings 42. Each of the leg members 16 has a non-skid foot 46 which is made of a rubber material and the like.

Figure 4:
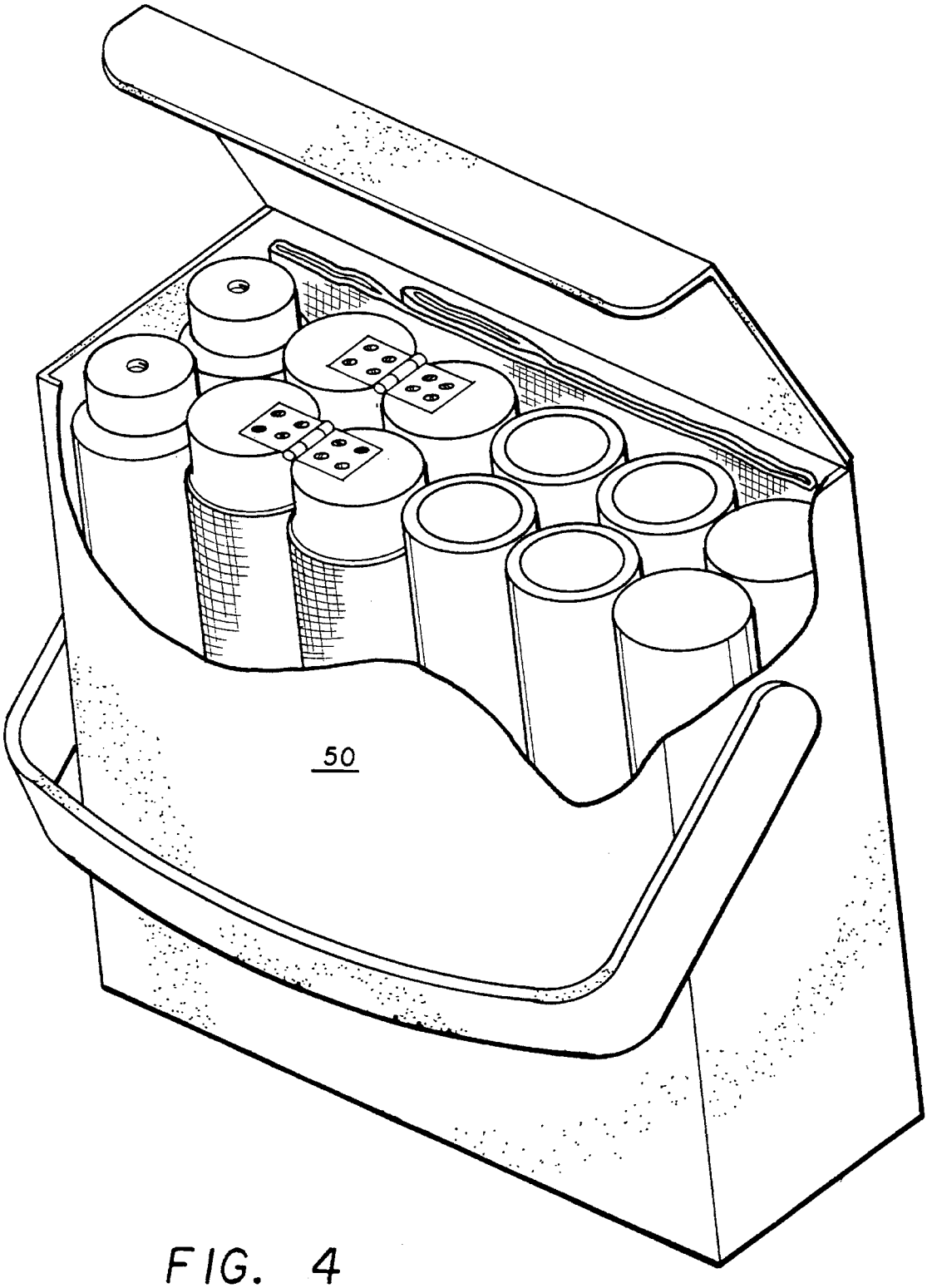
FIG. 4 is a perspective view of an elongated pouch for holding the chair parts in a collapsed or folded condition which parts are arranged therein in a substantially elongated manner.
Figure 1:
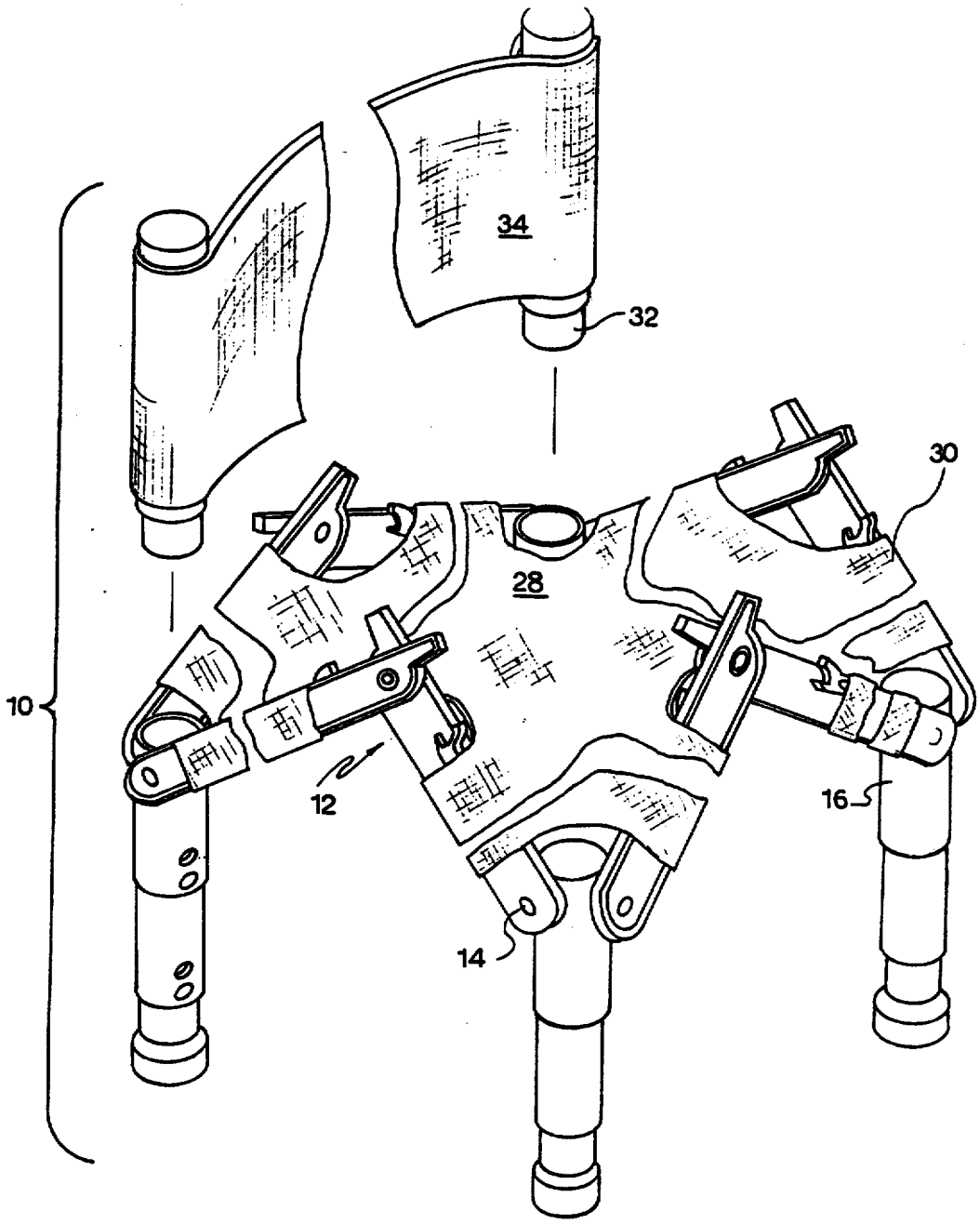
Figure 2:
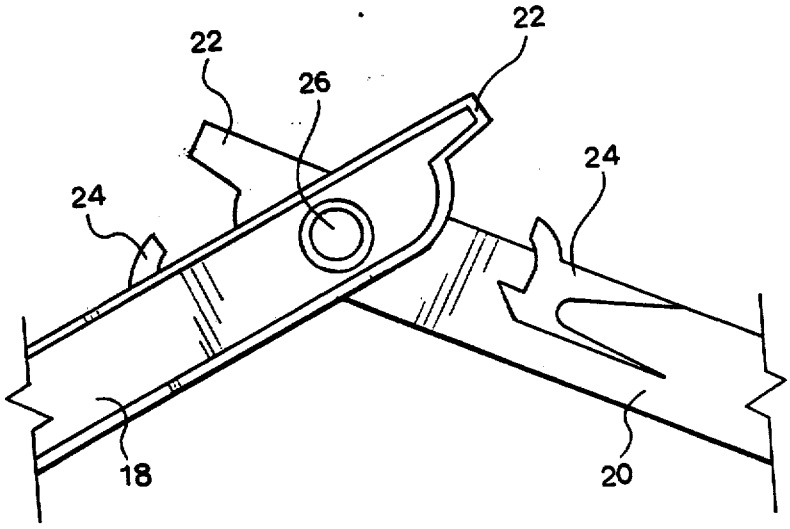
Figure 3:
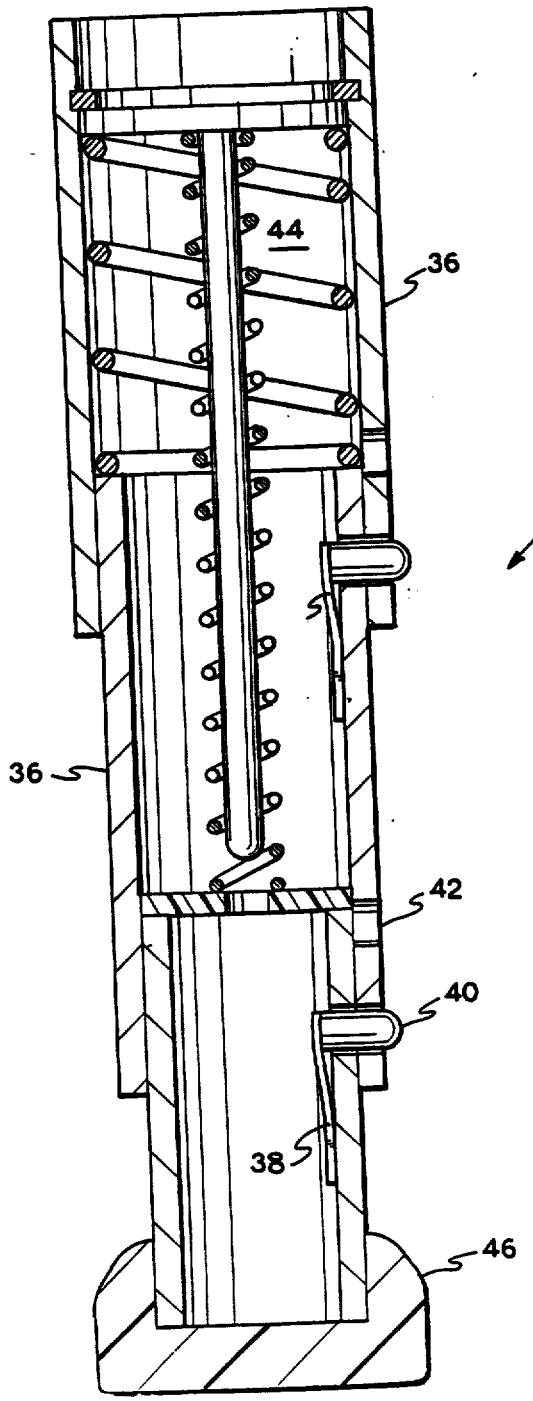
Figure 4:
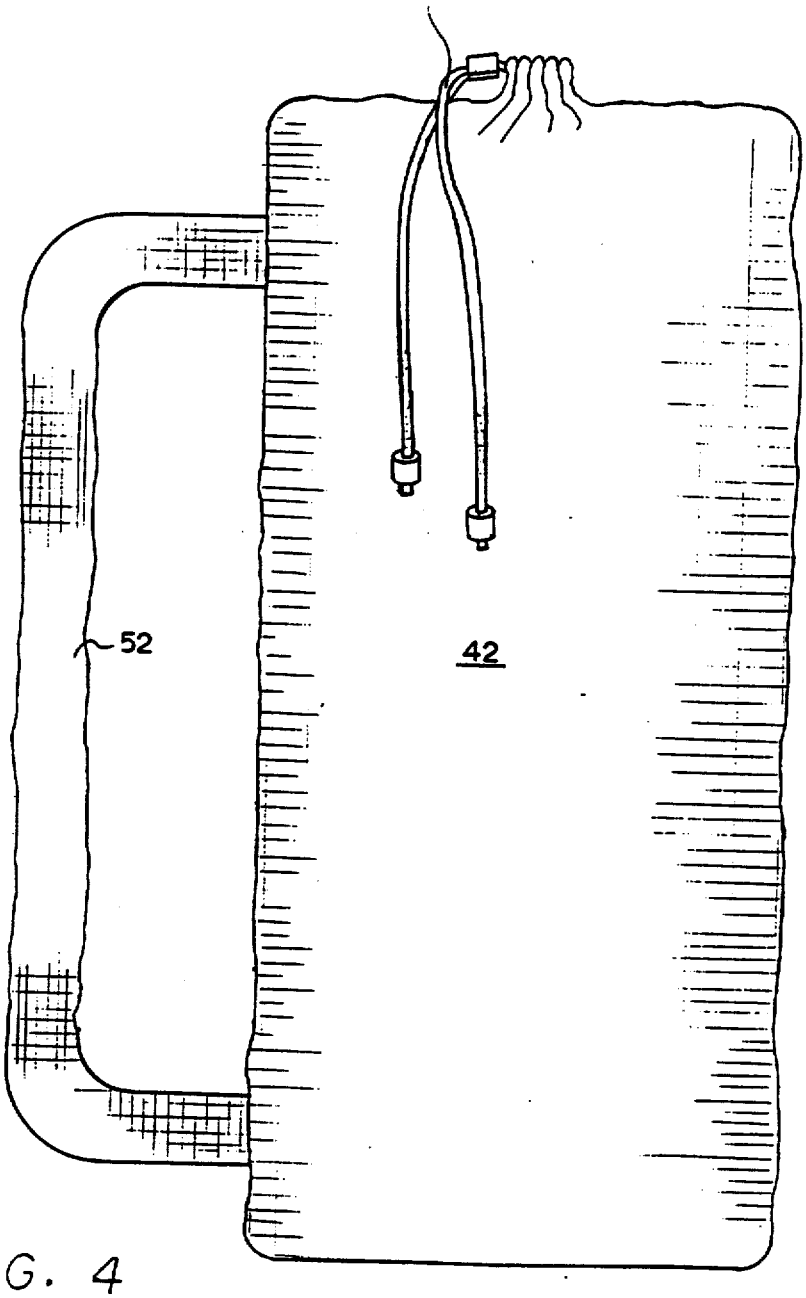

To ready all of the various chair parts for easy storage and transport, they are placed in their respective collapsed or folded condition, assembled in an elongated compact arrangement and inserted in an elongated manner into an elongated-shaped pouch or bag 50, as illustrated in FIG. 4. The pouch 48 has a drawn string 50 at the top thereof. A substantially U-shaped handle 52 is mounted on one side of the elongated-shaped pouch 48 whereby the chair in its compact condition may be easily transported.

In summary, a typical chair constructed according to the teaching of the instant invention, is a collapsible chair which may be used at the beach, park, recreational area and the like. Such a chair weighs 3 to 5 pounds and is about 24 inches in length in its collapsed position. The frame of the chair is composed of lightweight hollow tubes which are made of plastic, aluminum, or steel. The tubular frame at its respective intersection is secured by appropriate pin and slot couplers. Each of the sectional tubes for the seat frame is hinged at their respective median points, providing for further collapsibility by their folded conditions. Flexible canvas swatches constitute the seat and back supporting areas. The swatches with their sleeves inserted in their respective support tubular members are rolled on their adjacent support tubular members during the disassembly stage. Telescopic-type legs are adjustable and spring-pressed mounted which allow for various height settings in a rigid and sturdy manner, as well as their collapsible feature which allows for compact storage. The assembling of the various tubes and canvas swatches in their collapsible elongated conditions, results in an elongated compact package which can be readily inserted into a pouch made of plastic, leather or nylon. Thus, the recreational chair is readily adapted for use in an assembled erect seated chair position or in a disassembled or folded storage position.

It is to be understood that the present invention is not limited to the sole embodiment described above, but encompasses any and all embodiments within the scope of the following claims.

I claim:

1. A recreational chair comprising:

four leg members including two front leg members and two rear leg members, each of said leg members having an upper end;

a front rod member, a rear rod member, and a pair of side rod members, each of said rod members including a median pivot between a first end and an opposite second end, each end of said rod members pivotally attached to the upper end of each of said leg member such that said rod members form a substantially square horizontal frame when in a deployed position;

a flexible seat directly secured to each of said rod members;

two back frame members removably attachable to the upper ends of said two rear leg members; and a flexible back secured to and extending between each of said back frame members, whereby the chair has a collapsible storage position formed by folding said rod members at each median pivot and removing said back frame members from said rear leg members.

2. The recreational chair according to claim 1, wherein the back members and the leg members are hollow tubular members.

3. The recreational chair according to claim 1. wherein each rod members includes a snap-latch device adjacent each said median pivot of said rod members.

4. The recreational chair according to claim 1, wherein the flexible seat and back are made of a foldable fabric material.

5. The recreational chair according to claim 1, wherein the flexible back is adapted to be rolled into a compact package for storage.

6. The recreational chair according to claim 1, wherein each of the leg members includes a non-skid foot member at its bottom thereof.

7. The recreational chair according to claim 1, wherein each of the leg members includes a plurality of adjustably hollow tubular segment members connected in end-to-end relation for axial, telescoping movement between mutually extended and retracted positions of the segment members.

8. The recreational chair according to claim 7, wherein each of the leg members includes a spring-bias device associated with the tubular segment members facilitating length adjustment of respective leg members.

9. The recreational chair according to claim 1, wherein the rod members and leg members are attached to each other with rivet-type connections.

10. The recreational chair according to claim 3, wherein each said snap-latch device includes a pair of nose portions disposed adjacent each said pivot of each said rod members and a pair of adjacent U-shaped holders for receiving said nose portions when in the deployed position.

* * * * *

UNITED STATES PATENT AND TRADEMARK OFFICE

CERTIFICATE OF CORRECTION

PATENT NO. : 5,536,063

DATED : July 16, 1996

INVENTOR(S) : C. Cecelia Cable

It is certified that error appears in the above-indentified patent and that said Letters Patent is hereby corrected as shown below:

The title page, should be deleted showing the illustrated figure 1 and substituted with the attached title page showing figure 1

In the drawings

Sheet 1, Fig. 1, cancel drawing and substitute attached Fig. 1.

Figure 2:
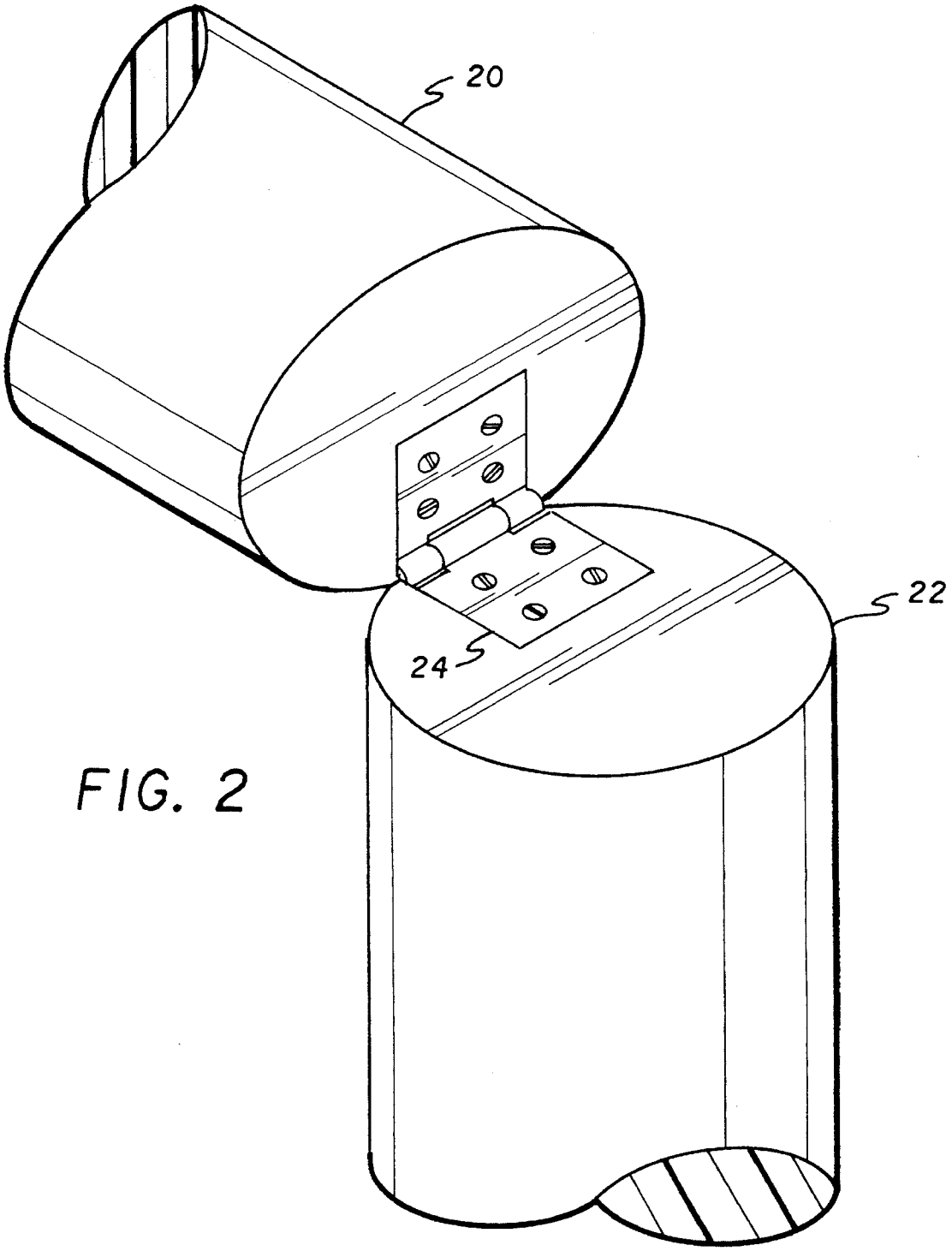
FIG. 2 is a detail view showing a snap-latch for hinging median sections of a front or rear seat frame tubular member.

Sheet 2, Fig. 2, cancel drawing and substitute attached Fig. 2.

Sheet 3, Fig. 3, reference numeral "36" should read --16--; "38" (both occurrences) should read --36--; "40" should read --38--; "42" should read --40--; "44" should read --42--; and reference numeral "48" should read --46--. [See attached Fig. 3].

Sheet 4, Fig. 4, cancel appearing drawing and substitute Fig. 4 attached herewith.

Signed and Sealed this

Nineteenth Day of November, 1996

Bruce Lehman

*Attest:*

BRUCE LEHMAN

*Attesting Officer*

*Commissioner of Patents and Trademarks*

United States Patent [19]

Cable

[11] Patent Number: 5,536,063

[45] Date of Patent: Jul. 16, 1996

[54] COLLAPSIBLE RECREATIONAL CHAIR

[76] Inventor: C. Cecelia Cable, 3433 E. Shaw Butte Dr., Phoenix, Ariz. 85028-1334

[21] Appl. No.: 368,438

[22] Filed: Jan. 4, 1995

[51] Int. Cl.[6] ..... A47C 4/28

[52] U.S. Cl. ..... 297/16.2; 297/45; 297/440.16

[58] Field of Search ..... 297/45, 16.2, 59, 297/16.1, 440.16

[56] References Cited

U.S. PATENT DOCUMENTS

| | | | |
|---|---|---|---|
| Re. 31,760 | 12/1984 | Kassai | 297/45 X |
| 1,263,717 | 4/1918 | Stone | 297/45 |
| 1,381,136 | 6/1921 | Ribeiro | 297/16.2 X |
| 3,977,721 | 8/1976 | Peterson | 297/45 |
| 4,243,263 | 1/1981 | Thiboutot | 297/45 X |
| 4,245,849 | 1/1981 | Thiboutot | 297/16.2 X |
| 4,715,650 | 12/1987 | Berman et al. | 297/45 X |
| 4,801,176 | 1/1989 | Wolberg | 297/45 X |
| 4,890,882 | 1/1990 | Harrington . | |
| 5,058,950 | 10/1991 | Mann | 297/16.2 X |
| 5,069,503 | 12/1991 | Martinez . | |
| 5,244,250 | 9/1993 | Nordmeyer | 297/16.2 X |

FOREIGN PATENT DOCUMENTS

| | | | |
|---|---|---|---|
| 241062 | 7/1965 | Austria . | |
| 585711 | 12/1924 | France | 297/45 |
| 63123 | 4/1955 | France . | |
| 1202042 | 7/1959 | France | 248/188.8 |
| 2458248 | 2/1981 | France | 248/188.8 |
| 79735 | 6/1955 | Netherlands . | |
| 98121 | 2/1940 | Sweden . | |
| 816179 | 7/1959 | United Kingdom | 297/16.2 |
| 1417575 | 12/1975 | United Kingdom . | |
| 2026312 | 2/1980 | United Kingdom | 297/440.16 |

*Primary Examiner*—Peter M. Cuomo
*Assistant Examiner*—David E. Allred
*Attorney, Agent, or Firm*—Richard C. Litman

[57] ABSTRACT

A recreational chair may be assembled for a seated chair condition or disassembled or folded to a collapsed compact condition for easy handling and storage purposes. Rods form a square seat frame and are pivotably connected at their respective median points whereby the rod members may be folded in half for the compact storage condition. Each rod is bifurcated and the bifurcated parts constitute a snap-latch device whereby in a closed position, the device is locked for the seating condition and in an open position, the device is unlocked for the collapsible storage condition. Leg members and back frame members of the chair are constructed of hollow tubes which are made of a durable rigid lightweight material such as plastic, aluminum or steel. Supporting seat and back canvas swatches are mounted on their respective frames and each of the swatches may be compactly rolled for storage. The legs are adjustably mounted by virtue of their telescopic collapsible and spring-bias features which allows for various height settings of the chair and for collapsing for compact storage. The seat and back frames, the canvas swatches, and the legs in their respective collapsed conditions may be arranged in an elongated manner for storing in an elongated pouch made of plastic, leather or nylon.

10 Claims, 4 Drawing Sheets

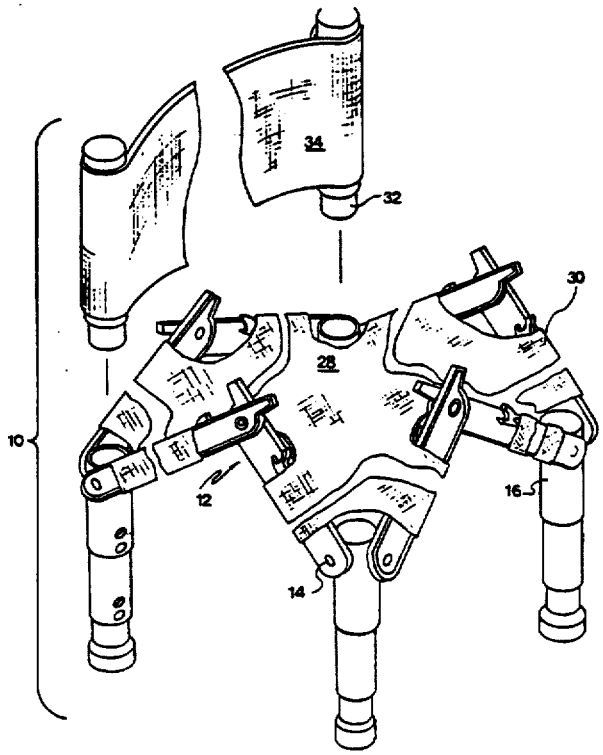

Copy provided by PTCS from the PTO APS Image Data Base on 09/30/1996